US008292525B2

(12) United States Patent
Kieser et al.

(10) Patent No.: US 8,292,525 B2
(45) Date of Patent: Oct. 23, 2012

(54) PRINTER WITH THERMOTRANSFER PRINT HEAD AND METHOD FOR CONTROL THEREOF

(75) Inventors: Axel Kieser, Berlin (DE); Raimund Nisius, Berlin (DE); Frank Reisinger, Oranienburg (DE); Dirk Rosenau, Berlin (DE); Sabine Roth, Berlin (DE); Olaf Turner, Berlin (DE)

(73) Assignee: Francotyp-Postalia GmbH, Birkenwerder (DE)

( * ) Notice: Subject to any disclaimer, the term of this patent is extended or adjusted under 35 U.S.C. 154(b) by 1287 days.

(21) Appl. No.: 12/014,297

(22) Filed: Jan. 15, 2008

(65) Prior Publication Data

US 2008/0213022 A1 Sep. 4, 2008

(30) Foreign Application Priority Data

Jan. 16, 2007 (DE) ..... 10 2007 003 138

(51) Int. Cl.
*B41J 2/315* (2006.01)

(52) U.S. Cl. ..... 400/120.08; 400/120.12

(58) Field of Classification Search ..... 400/120.08, 400/120.12

See application file for complete search history.

(56) References Cited

U.S. PATENT DOCUMENTS

| | | | | |
|---|---|---|---|---|
| 4,170,015 | A * | 10/1979 | Elliano et al. | 346/76.1 |
| 4,580,144 | A * | 4/1986 | Calvi | 347/171 |
| 4,659,416 | A | 4/1987 | Johansson | |
| 5,400,058 | A | 3/1995 | Helmbold et al. | |
| 5,426,451 | A * | 6/1995 | Brock et al. | 347/199 |
| 5,499,879 | A * | 3/1996 | Meetze | 400/234 |
| 6,236,752 | B1 * | 5/2001 | Katayama et al. | 382/183 |
| 6,415,983 | B1 * | 7/2002 | Ulvr et al. | 235/487 |
| 6,793,334 | B2 * | 9/2004 | Blackman et al. | 347/107 |
| 7,508,405 | B2 * | 3/2009 | Kunde et al. | 347/188 |
| 7,880,754 | B2 * | 2/2011 | Kunde | 347/188 |
| 2003/0117262 | A1 * | 6/2003 | Anderegg et al. | 340/5.53 |
| 2006/0139436 | A1 | 6/2006 | Kunde et al. | |

FOREIGN PATENT DOCUMENTS

| | | | |
|---|---|---|---|
| DE | 40 26 896 | A1 | 2/1992 |
| DE | 10 2004 063 756 | A1 | 7/2006 |
| JP | 56-111971 | A | 9/1981 |

* cited by examiner

*Primary Examiner* — Anthony Nguyen
(74) *Attorney, Agent, or Firm* — Schiff Hardin LLP

(57) ABSTRACT

In a method for controlling a print head with a number of printing elements operating according to the thermotransfer principle, an energy quantity is fed to a printing element in a feed step in order to transfer ink from an ink carrier device associated with the print head to a substrate associated with the ink carrier device to generate an image point of a barcode, with the energy quantity being adjusted dependent on the position of the image point in the barcode.

20 Claims, 4 Drawing Sheets

106.1
START
106.2
Print?
Y
N
106.3
Calculate print image, energy templates, phase length function
106.4
Select image point
106.5
Select energy template, select pulse count
106.8
106.6
Read out phase length from phase length function
106.7
Further image point?
Y
N
106.9
Control print elements
106.10
Stop?
Y
N
106.11
STOP

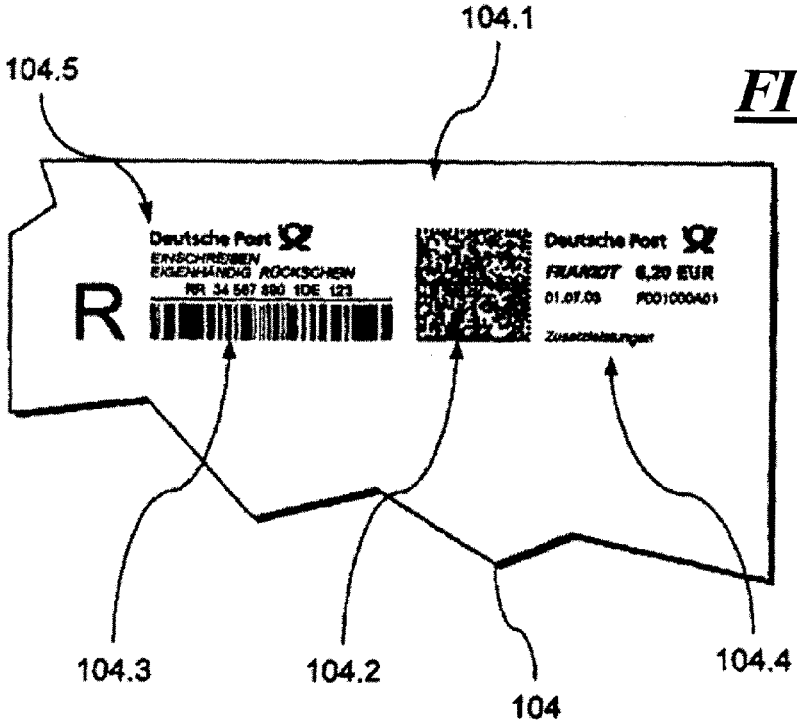
FIG. 3
FIG. 4
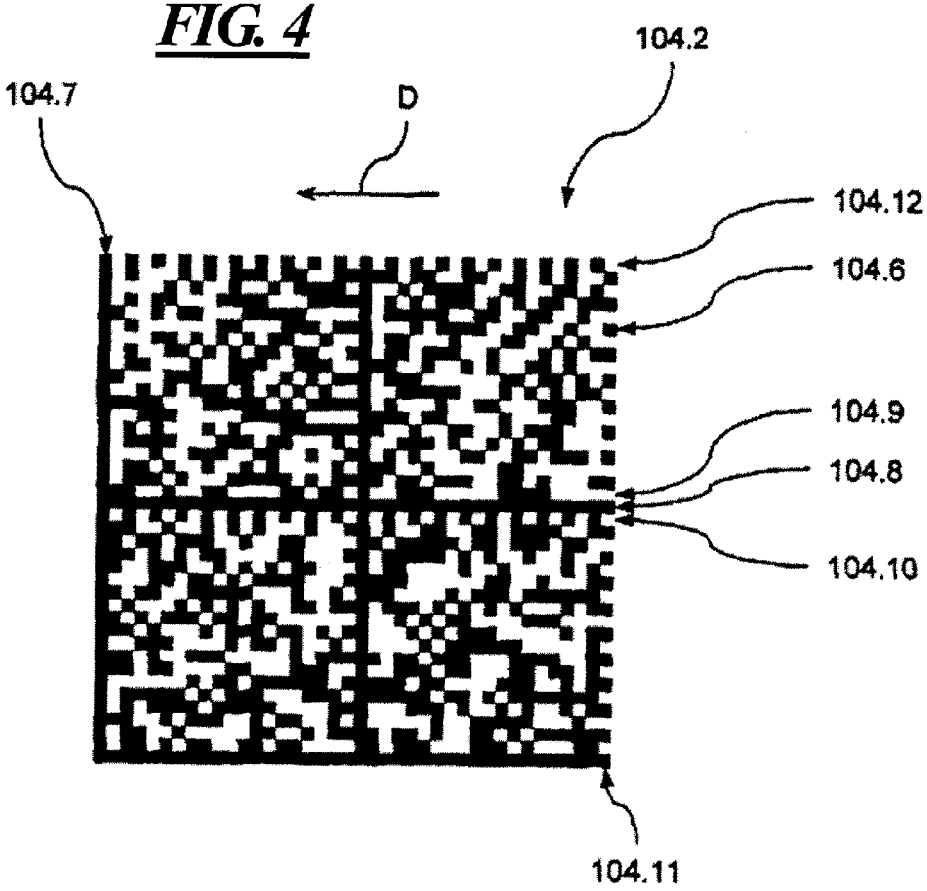

| | | | | | |
|---|---|---|---|---|---|
| 2 | 4 | 6 | 6 | 7 | 6 |
| 6 | 6 | 6 | 6 | 7 | 6 |
| 6 | 6 | 7 | 7 | 7 | 6 |
| 6 | 6 | 7 | 7 | 7 | 6 |
| 6 | 6 | 6 | 6 | 7 | 6 |
| 7 | 7 | 7 | 7 | 7 | 7 |

| | | | | | |
|---|---|---|---|---|---|
| 0 | 1 | 10 | 10 | 10 | 10 |
| 0 | 0 | 10 | 10 | 10 | 10 |
| 0 | 0 | 10 | 10 | 10 | 10 |
| 0 | 0 | 10 | 10 | 10 | 10 |
| 0 | 0 | 10 | 10 | 10 | 10 |
| 0 | 1 | 10 | 10 | 10 | 10 |

PRINTER WITH THERMOTRANSFER PRINT HEAD AND METHOD FOR CONTROL THEREOF

BACKGROUND OF THE INVENTION

1. Field of the Invention

The present invention concerns a method for controlling a print head operating according to the thermotransfer principle with a number of printing elements, of the type wherein an energy quantity is fed to a printing element in a feed step in order to transfer ink from an ink carrier device associated with the print head to a substrate associated with the ink carrier device to generate an image point of a barcode. The invention furthermore concerns a printer that is suitable for implementation of the inventive method.

2. Description of the Prior Art

The machine-readability of barcodes, particularly two-dimensional barcodes, depends heavily on the print quality. This is particularly true for two-dimensional barcodes with very small module sizes. For example, for the franking imprints accepted by the Canadian Post a two-dimensional barcode is required that is composed of 48×48 modules (printed or non-printed rectangular fields) on an area of 1 inch×1 inch, such that an edge length of the respective module of approximately 0.5 mm results.

Basic criteria for the print quality (and therewith the machine-readability) of such a barcode are a uniform size of the modules in both directions and a uniform coverage over the area of the entire barcode.

In order to obtain a qualitatively high-grade barcode in such thermotransfer printers as they are known from DE 40 26 896 A1, for example, the respective printing elements of the print head must be supplied with a relatively precisely dosed energy amount for each image point to be printed in order to reliably melt the ink particles in the desired quantity to achieve the desired spatial expansion of the carrier material of the ink ribbon. Depending on the current temperature of the respective printing element, more or less energy must be supplied in order to achieve an optimal melting temperature.

Furthermore, from DE 10 2004 063 756 A1 it is known in connection with franking imprints to use different printing parameter sets for different regions of a franking imprint with different print image types (clear text/graphics, one-dimensional barcode, two-dimensional barcode) in order to satisfy the different requirements of these print image types.

As in the printer known from DE 40 26 896 A1, the calculation of the energy quantity to be introduced into the appertaining printing element for the respective image point to be printed is undertaken for the region of a barcode to be printed dependent on the total energy input into the printing element, this energy input occurring as a result of the heat conduction from adjacent printing elements that were previously activated for printing, as well as the residual energy that still exists due to previous printings by the current printing element.

A relatively precise control of the printing elements is thereby possible, but a disadvantage is that a relatively complicated calculation is required for each image point to be printed, which reduces the processing speed for a print image and thus the throughput, of the printer also is reduced. In known printers this can be counteracted by providing more processing capability, thus requiring a more complicated and more expensive processor.

SUMMARY OF THE INVENTION

An object of the present invention is to provide a method and a printer of the aforementioned type that avoid, or at least alleviate, the aforementioned disadvantages, and in particular that enable a simple and economical improvement of the print image quality in a barcode.

The present invention is based on the insight that a simple and economical improvement of the print image quality of the region of a barcode to be printed is enabled when the energy quantity is set dependent on the position of the image point in the barcode. It has been shown that a sufficiently high print image quality can be achieved with reduced computational effort even when an adjustment of the energy quantity ensues without the known calculation of the energy quantity proceeding according to the same scheme for every image point to be printed. Rather, a simplified, position-dependent setting of the energy quantity can ensue at least for image points at specific points within a barcode.

For example, at the beginning of the printing of the barcode it can be assumed that a higher energy quantity should be introduced into the printing elements than in the middle or at the end of the barcode. For example, when printing a barcode a higher energy quantity is likewise normally to be introduced into the printing elements at the edges of the barcode running in the printing direction. Furthermore, two-dimensional barcodes are normally designed such that continuous surfaces for detection of the barcode are printed at specific points of the barcode (normally module columns or rows in the region of the edges as well as in the middle of the barcode). These continuous surfaces, due to the continuous printing thereof, require a lower energy feed that can be sufficiently precisely established in advance or can be determined in a simple manner.

Particularly for two-dimensional barcodes the image points lying at the trailing (in the printing direction) end of a printed module usually require a smaller energy quantity than previously printed image points, due to the residual heat that still remains. For two-dimensional barcodes a simple, position-dependent adjustment of the energy dependent on the position of an image point within a module of the barcode is thus possible.

The above object is achieved in accordance with the invention by a method for controlling a print head with a number of printing elements operating according to the thermotransfer principle, in which an energy quantity is fed to a printing element in a feed step in order to transfer ink from an ink carrier device associated with the print head to a substrate associated with the ink carrier device to generate an image point of a barcode, wherein the energy quantity is adjusted dependent on the position of the image point in the barcode.

In preferred variants of the inventive method, the energy quantity to be fed to the printing element in the feed step is determined in a determination step dependent on the position of the image point in the barcode and is subsequently correspondingly set. In other variants of the invention the energy quantity can be set dependent on position via only one parameter of the energy feed (for example the phase length of the energy pulses fed to the printing element) and this parameter is varied dependent on the position of the image point in the barcode.

These variants can be particularly advantageously used when the barcode is a two-dimensional barcode with a number of printed and non-printed barcode modules arranged like a matrix, the printed barcode module being composed of a number of image points and the image points forming one part of the barcode module. The energy quantity to be fed to the printing element in the feed step can then be determined in a simple manner in the determination step dependent on the position of the barcode module in the barcode. It is thus possible to already predetermine at least an initial value for the adjustment of the energy quantity using the position of the barcode module in the barcode, the use of this initial value simplifying the calculations in the determination step.

The energy quantity to be fed to the printing element in the feed step is advantageously determined in the determination step dependent on the print status of predetermined neighboring barcode modules. The predetermined neighboring barcode modules are those that are adjacent to the barcode module. The print status of the respective neighboring barcode module reflects whether it is a printed or a non-printed barcode module. Thus it is possible not only to have the printing history influence the determination of the energy quantity, but also the future course of printing can be taken into account. The consideration at the level of the barcode modules instead of the conventional consideration at the level of the image points significantly simplifies the required data processing.

A particularly simple data processing is achieved when the energy quantity to be fed to the respective printing element in the respective feed step is determined for the image points of a barcode module using an energy template, with at least one separate energy template being provided for each print status configuration of the predetermined neighboring barcode module. Such an energy template can include a value for each image point of the barcode module, this value then being used to determine the energy quantity required for this image point.

For example, for a barcode module of a two-dimensional barcode with eight neighboring barcode modules, the print status of the four neighboring barcode modules adjoining the edges of the barcode module can be taken into account. Since the respective neighboring barcode module can exhibit two different states (printed and unprinted), in this case $2^4=16$ different print status constellations arise. 16 different energy templates thus are provided for the respective barcode module. If the neighboring barcode modules at the four corners of the barcode module are additionally considered, $2^8=256$ different print status constellations result and therewith 256 different energy templates.

The number of the different energy templates, however, may be significantly reduced at specific points in the barcode. For example, a two-dimensional barcode according to the data matrix standard is printed with a fixed, predetermined barcode module pattern in the region of its edges as well as in the region of the middle barcode module columns and rows, such that a distinctly lower number of energy templates to be used (possibly even only a single energy template to be used) results for barcode modules in these regions (consequently dependent on the position in the barcode).

The values contained in the respective energy template can designate different suitable values, which can be used for the adjustment of the energy quantity for the respective printing element. They can represent an actual energy value which is read out and converted into corresponding control signals for the printing element. Values of a physical gravity that can be used with optimally little recalculation effort for controlling the respective printing element are advantageously used in the energy template.

In the feed step the energy quantity is preferably supplied via a number of current pulses, and the at least one energy template then comprises values each representing the number of current pulses to be fed for the respective image point. The respective value can then be directly read from the energy template and used to control the appertaining printing element.

In further preferred variants of the inventive method, the at least one energy template is fixed. A variation of the energy quantity dependent on further parameters, for example dependent on the actual temperature of the print head or other components participating in the printing, can then simply ensue by changing the length and/or the number of the pulses, for example.

It is likewise possible to provide different energy templates for different values of these parameters and then to select that energy template that corresponds to the actual situation (thus, for example, the actual temperature of the print head) dependent on the current value of the appertaining parameter. An energy template is therefore fixed for each of different states of the print head, in particular for different temperatures of the print head, and the current energy template to be used is selected dependent on the current state of the print head, in particular dependent on the current temperature of the print head.

In other variants of the inventive method, an energy template is used (as the at least one energy template) that is calculated dependent on the state of the print head (in particular dependent on the current temperature of the print head). This is preferably realized as an energy template that is fashioned as a parameterized master energy template.

The calculation of the appertaining energy template can in principle ensue in any suitable manner. The energy template is advantageously calculated upon the occurrence of predetermined conditions or events. It is thus possible to recalculate the energy templates at predeterminable points in time, after a predeterminable number of activations of the printing elements, upon occurrence of a predeterminable change of the appertaining parameter, etc.

In further preferred variants of the inventive method, the energy quantity fed to the printing element in the feed step is set by at least one variable parameter of the energy feed to the printing element, dependent on the position of the image point in the barcode. Such variable parameters of the energy feed can be, for example, the current strength, the voltage or the length (phase length) of current pulses fed to the printing element. The energy quantity is therefore advantageously fed via a number of current pulses in the feed step, and the voltage, the current strength or the duration of the respective current pulse is used as the at least one variable parameter.

A particularly simple adjustment possibility results by the variation of the phase length since this can be achieved by a simple temporal control of otherwise unaltered circuits. For this purpose, the energy quantity is fed as a number of current pulses in the feed step with the durations of the respective current pulses being used as a variable parameter, at least one phase length function representing the relationship between the duration of the respective current pulse and the position of the image point in the barcode being used.

The at least one phase length function can be fixed. The variation of the energy quantity dependent on further parameters, for example dependent on the actual temperature of the print head or other components participating in the printing, can then simply ensue through the number of the pulses.

It is likewise possible to provide different phase length functions for different values of these parameters and then, dependent on the current value of the appertaining parameter, to select that phase length function which corresponds to the actual situation (thus, for example, the actual temperature of the print head). A phase length function is therefore fixed for each of different states of the print head, in particular for different temperatures of the print head, and the current phase length function to be used is selected dependent on the current state of the print head, in particular dependent on the current temperature of the print head.

In other variants of the inventive method, a function that is calculated dependent on the state of the print head, in particular dependent on the current temperature of the print head, is used as the at least one phase length function. This is preferably realized as a phase length function that is fashioned as a parameterized master function.

In principle the calculation of the appertaining phase length function can ensue in any suitable manner. The phase length function is advantageously calculated upon the occurrence of predetermined conditions or events. It is thus possible to recalculate the phase length function at predeterminable points in time, after a predeterminable number of activations of the printing elements, upon occurrence of a predeterminable change of the appertaining parameter etc.

Furthermore, the present invention concerns a printer with a printing device operating according to the thermotransfer principle, which printing device comprises a print head with a plurality of printing elements, a processing unit connected with the print head to control the print head and an ink carrier device associated with the print head. The processing unit is fashioned to determine the energy quantity to be fed to the printing element and to initiate the feed of the energy quantity to the printing element in order to transfer ink from the ink carrier device onto a substrate associated with the ink carrier device to generate an image point of a barcode. According to the invention, the printing device is fashioned to adjust the energy quantity dependent on the position of the image point in the barcode.

The inventive method can be executed and the variants and advantages described above can be realized to the same degree as for the printer.

The data used in the printing, for example the energy templates and/or phase length functions described above, can be stored in a memory of the printing device of the printer or in a memory of the ink carrier device. The storage of at least a part of these data in the ink carrier device thereby in particular entails the advantage that a particularly simple tuning of the printing process to the employed ink carrier is possible. The present invention accordingly also concerns an ink carrier device (in particular an ink ribbon cassette) for an inventive printer, which ink carrier device comprises a memory in which the at least one energy template and/or the at least one phase length function is stored in a fixed manner.

The method described above as well as the printer described above can be used for arbitrary printing tasks, but they are advantageously used in the field of the printing franking imprints since in that field barcodes with particularly small module sizes are often used on print media with a strongly scattering surface quality given simultaneously high requirements for the machine-readability. The present invention accordingly furthermore concerns a franking machine with an inventive printer.

BRIEF DESCRIPTION OF THE DRAWINGS

FIG. 3 is a schematic representation of a print image that was generated with the printer from FIG. 1 using the inventive method;

FIG. 4 shows a two-dimensional barcode at an enlarged scale as is used in the print image of FIG. 3.

DESCRIPTION OF THE PREFERRED EMBODIMENTS

Figure 1:
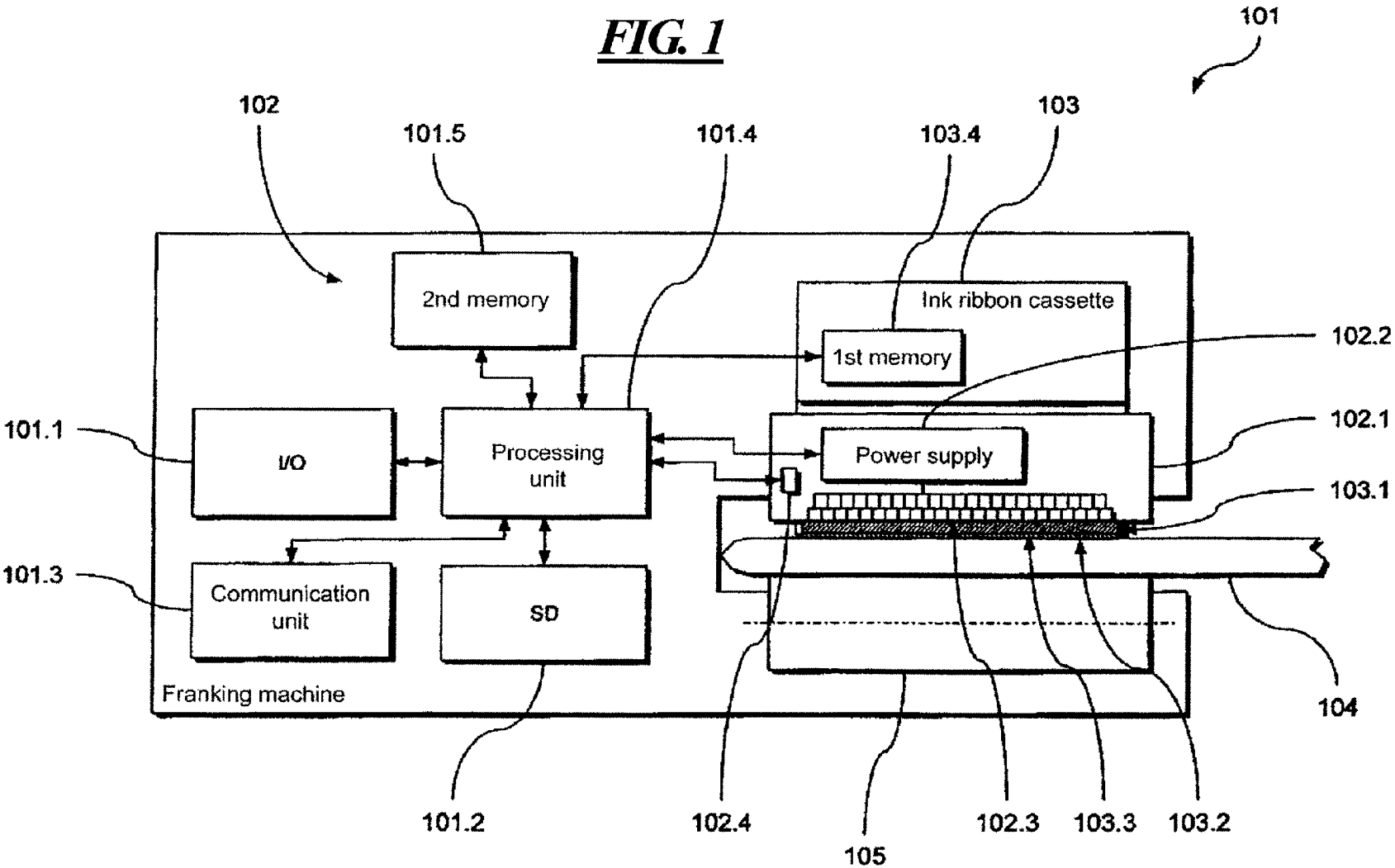
FIG. 1 schematically illustrates a preferred embodiment of the inventive printer with which a preferred embodiment of the inventive method for controlling a print head can be implemented.
Figure 2:
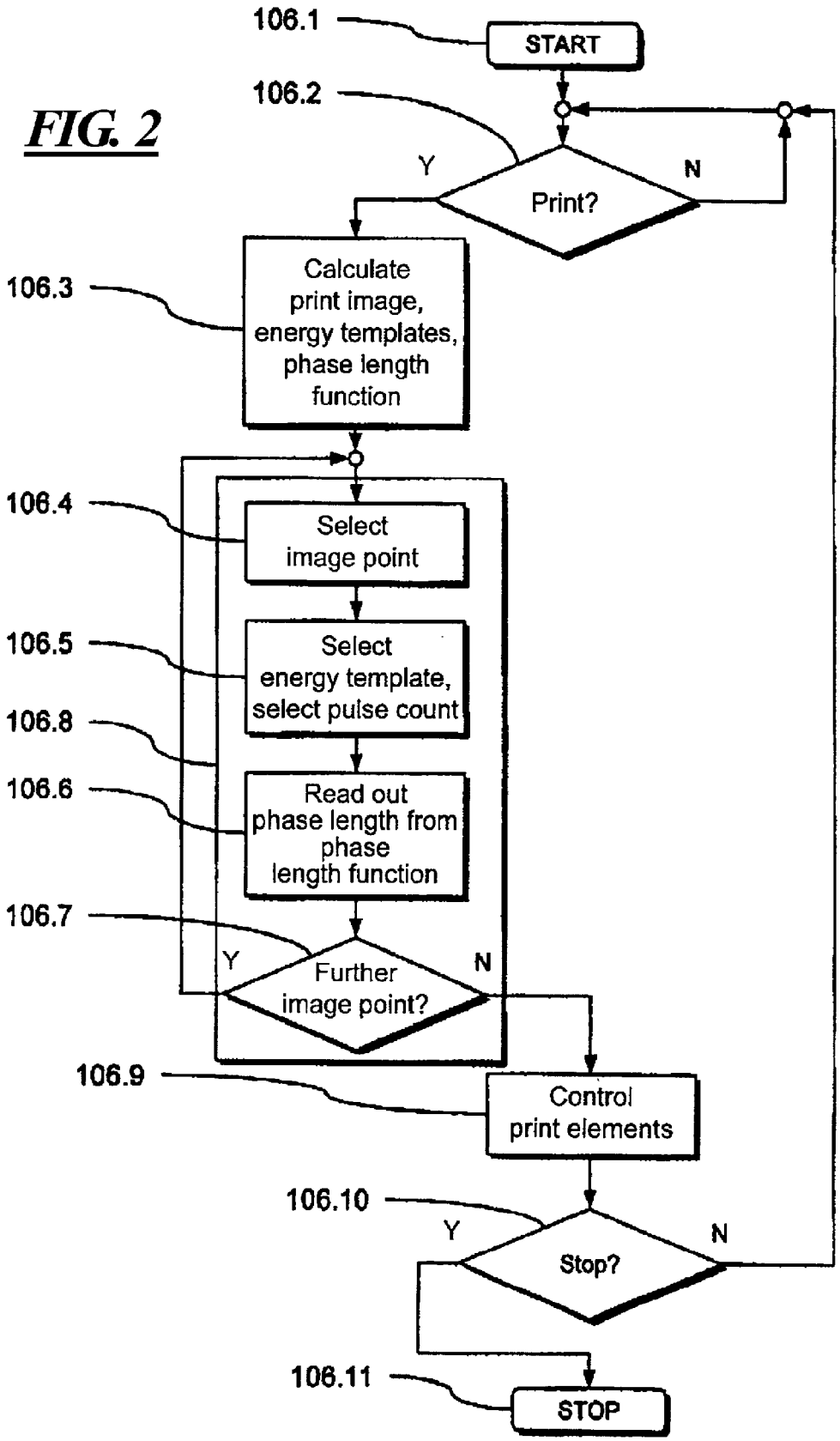
FIG. 2 is a flowchart of a preferred embodiment of the inventive method for controlling a print head that is implemented with the printer of FIG. 1.

FIG. 1 schematically shows a franking machine 101 with a preferred embodiment of the inventive printer 102. The printer 102 is operated using a preferred embodiment of the inventive method for controlling a print head.

The printer 102 represents the printer unit of the franking machine 101. In addition to the printer 102, the franking machine 101 comprises further components such as, for example, an input/output unit 101.1, a security module 101.2 in the form of what is known as a PSD or SAD (SD for short) and a communication unit 101.3

A user can enter information into the franking machine 101 or information can be output to a user via the user interface unit 101.1, for example, a module with keyboard and display. The security module 101.2 provides secure functionalities for physical and logical securing of the security-relevant data of the franking machine 101. The franking machine 101 can be connected with remote devices (for example a remote data center) via the communication unit 101.3, for example via a communication network.

The printer 102 has, among other things, a processing unit 101.4, a print head 102.1 and an ink carrier device in the form of an ink ribbon cassette 103. The processing unit 101.4 is a central processing unit of the franking machine 101 which, in addition to other functions, takes on the control of the print head 102.1 in the printing.

The print head 102.1 has an energy supply device 102.2 that supplies a series of n printing elements 102.3 with energy. At this point it is noted that the printing elements 102.3 are only schematically depicted in FIG. 1, and the print head 102.1 normally exhibits a distinctly higher number of printing elements than is shown in FIG. 1. The energy supply device 102.2 is correspondingly controlled by the processing unit 101.4 to supply the printing elements 102.3 with energy.

The ink ribbon cassette is associated with the print head 102.1 such that its ink ribbon 103.1 with its ink carrier 103.3 contacts the printing elements 102.3 of the print head 102.1. For printing the printing elements 102.3 (controlled by the processing unit 101.4) are respectively supplied by the energy supply device 102.2 with a precisely dosed energy quantity in order to melt local ink particles of the ink layer 103.2 that are located on the ink carrier 103.3 of the ink ribbon 103.1. These ink particles are then transferred onto a substrate (here a letter 104 to be franked). For this purpose, the letter 104 is guided past the print head 102.1 and is pressed by pinch rollers (one pinch roller 105 being shown in FIG. 1) against the ink ribbon 103.1 lying between them.

The energy supply device 102.2 introduces the energy quantity required for the respective image point into the corresponding printing element 102.3 via a specific number Z of energy pulses of a specific length (what is known as the phase length).

The ink ribbon cassette 103 has a first memory 103.4 that is automatically connected with the processing unit 101.4 via corresponding contact elements upon association of the ink ribbon cassette 103 with the printer 102, in other words thus upon insertion of the ink ribbon cassette 103 into the franking machine 101. Print parameters associated with the ink ribbon cassette 103, which print parameters are (as explained in detail in the following) used to control the print head 102.1, are stored in the first memory 103.4.

FIG. 3 shows a print image in the form of a franking imprint 104.1 according to the specification of the Deutsche Post AG, which franking imprint 104.1 was generated on the letter 104 with the print head 102.1. The franking imprint 104.1 is composed of different sub-regions 104.2 through 104.5. The first sub-region 104.2 is thus a two-dimensional barcode and the second sub-region 104.3 is a one-dimensional barcode while the third and fourth sub-regions 104.4 and 104.5 are respectively a region with text and free graphics.

With regard to sharpness and contrast of the print image 104.1, given the two-dimensional barcode 104.2 (as is shown in enlarged scale in FIG. 4) high requirements for sharpness and contrast exist in the region of the edges of the rectangles or squares generated via the image points, which rectangles or, respectively, squares are designated in the following as barcode modules 104.6. This applies both in the printing direction D and also transverse to this.

In order to satisfy these high quality requirements in the region of the barcode 104.2, a sufficiently precise adjustment of the energy quantity that is fed to the respective printing element 102.3 is necessary. In order to achieve such a sufficiently precise adjustment of the energy quantity for the respective image point to be printed, in the present example (as is subsequently explained in detail) energy templates and phase length functions are used which reduce the processing expenditure in the processing unit 101.4 relative to the known methods for adjustment of this energy quantity and thus ensure a high throughput of the franking machine 101 given sufficient print quality.

In the following a preferred embodiment of the inventive method for controlling a print head is described with reference to FIGS. 1 through 6, which method is implemented with the printer 102 from FIG. 1.

First the method workflow is started in a step 106.1. It is thereby detected that a new ink ribbon cassette 103 has been correctly inserted into the franking machine 101; the processing unit 101.4 reads the print parameters from the first memory 103.4 that is connected with the processing unit 101.4 via corresponding contact elements. In order to ensure that the correct print parameters are always used, it can be provided that the use of a new ink ribbon cassette 103 in the operation of the franking machine 101 always forces a restart of the method workflow with the step 106.1.

The processing unit 101.4 stores the print parameters in a second memory 101.5 (connected with the processing unit 101.4) in the form of a volatile working memory of the franking machine 101. In other variants of the invention, the second memory can be a non-volatile memory.

In a step 106.2 it is checked whether a printing procedure should be implemented; for example, a letter 104 should thus be franked. If this is not the case, the workflow jump back to the step 106.2.

If a printing procedure should be implemented, the print image 104.1 to be generated is initially calculated by the processing unit 101.4 in a step 106.3. This occurs in a conventional manner, such that it should not be discussed in detail here.

Figure 5A:
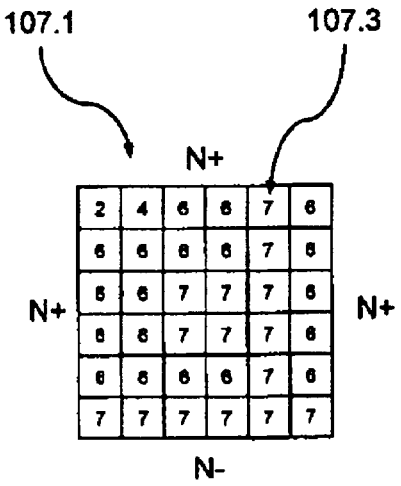
FIG. 5A illustrates an energy template that can be used in the method of FIG. 2.
Figure 5B:
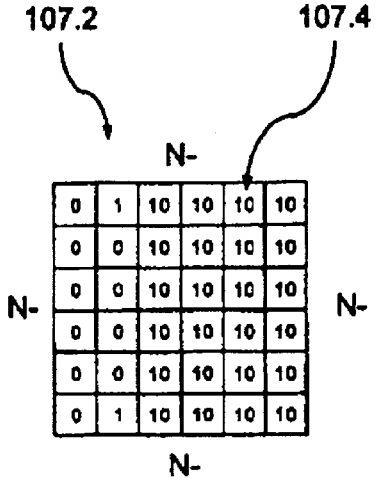
FIG. 5B illustrates a further energy template that can be used in the method of FIG. 2.

Furthermore, in the step 106.3 the processing unit 101.4 possibly calculates a series of energy templates 107.1, 107.2 a they are illustrated, for example, in FIGS. 5A and 5B. In the present example the appertaining energy template 107.1, 107.2 is calculated using a series of input parameters from a parameterized master energy template that is stored in the second memory 101.5.

In principle any suitable parameter which has an influence on the energy quantity to be fed to a printing element 102.3 for generation of an image point can be suitable as an input parameter for the calculation of the energy templates. In the present example the appertaining energy template 107.1, 107.2 is calculated using at least one part of the print parameter (read out from the first memory 103.4) of the ink ribbon 103.1 as an input parameter as well as temperature measurement value T representative of the current temperature of the print head 102.1 as a further input parameter. The temperature measurement value T is provided by a temperature sensor 102.4 connected with the processing unit 101.4.

In other variants of the invention, instead of the calculation of the energy templates via a master energy template, an energy template set is provided from among different energy templates that are stored for different combinations of the input parameters. The respective energy template to be used then does not have to be calculated but rather is simply selected from the appertaining energy template set using the current combination of the input parameters.

These energy templates 107.1, 107.2 are respectively associated with a barcode module type and in the present example are even designed as a type of matrix (corresponding to the generation of the barcode modules 104.6 via a matrix of image points). Each value 107.3, 107.4 in the appertaining energy template 107.1, 107.2 thereby designates the number Z of the energy pulses which the energy supply device 102.2 feeds to the appertaining printing element 102.3.

In other variants of the invention the respective value in the energy template can be a different value required or representative for the adjustment of the energy quantity to be fed to the printing element 102.3. The value can directly designate an energy quantity.

An energy template set with a number of energy templates 107.1, 107.2 is calculated for each barcode module type dependent on the possible print status constellations of the neighboring modules of a barcode module 104.6. In the present example the print status of the neighboring modules at the four edges of the barcode module 104.6 is used.

FIG. 5A shows the energy template 107.1 (for example for a specific barcode module type) for a print status constellation in which the left neighboring module, the upper neighboring module and the right neighboring module are printed (print status: N+) while the lower neighboring module is not printed (print status: N−). By contrast, for this barcode module type FIG. 5B shows an energy template 107.1 for a print status constellation in which all neighboring modules are not printed (print status: N−).

According to the present invention, different barcode module types are defined for different regions of the barcode 104.2. A first barcode module type is thus associated with the barcode modules 104.6 of the left module column 104.7. A second barcode module type is associated with the remaining barcode modules 104.6 of the middle module row 104.8. A third barcode module type is associated with the remaining barcode modules 104.6 of the module row 104.9 above the middle module row 104.8 while a fourth barcode module type is associated with the remaining barcode modules 104.6 of the module row 104.10 below the middle module row 104.8. A fifth barcode module type is associated with the still remaining barcode modules 104.6 of the right module column 104.11. A sixth barcode module type is associated with the still remaining barcode modules 104.6 of the upper module row 104.12. Finally, a seventh barcode module type is associated With all remaining barcode modules 104.6. A different number and association of the barcode module types can also be provided in other variants of the invention.

A master energy template set with a plurality of master energy templates is in turn associated with each barcode module type. In the master energy template set a master energy template from which a current energy template 107.1, 107.2 is then respectively calculated in the manner described above is provided for each print status constellation possible in the appertaining barcode module type. In the present example $2^4$=16 different print status constellations (and therewith 16 different master energy templates) therefore result for the barcode module 104.6 of the seventh barcode module type. In contrast to this, due to the always-unprinted left neighboring module only $2^3$=8 different print status constellations (and therewith only eight different master energy templates) result for the barcode module 104.6 of the barcode module type.

At this point it is again noted that, in the already cited different variants of the invention without calculation of the energy templates via the master energy templates, the number of the energy templates stored for each barcode module type is distinctly higher. Different energy templates are then stored there for each barcode module type and for each print status constellation p, with p being the number of the possible different combinations of the aforementioned input parameters using which the selection of the current energy template to be used is made. Although a larger memory capacity is thus required in these variants, due to the simple selection of the energy templates a lower computing capacity of the processing unit is possibly required.

The calculation of the respective current energy template set with the current energy templates 107.1, 107.2 can ensue in each r-th pass of the step 106.3 (with r≧1). The calculation can also be linked to the occurrence of arbitrary other temporal and non-temporal conditions or, respectively, events. It is possible for this calculation to be implemented only in the step 106.3 when one of the aforementioned input parameters of the calculation has changed by more than a predetermined value. This can be the case, for example, when a new ink ribbon 103.1 with correspondingly deviating print parameters was inserted or when the temperature measurement value T (and therewith the temperature of the print head 102.1) has changed by more than a predetermined value. Such a change can even force a restart of the method workflow in the step 106.1, depending on the severity. The same naturally also applies for the selection of the current energy templates in the aforementioned variants without calculation of the energy templates.

Figure 6:
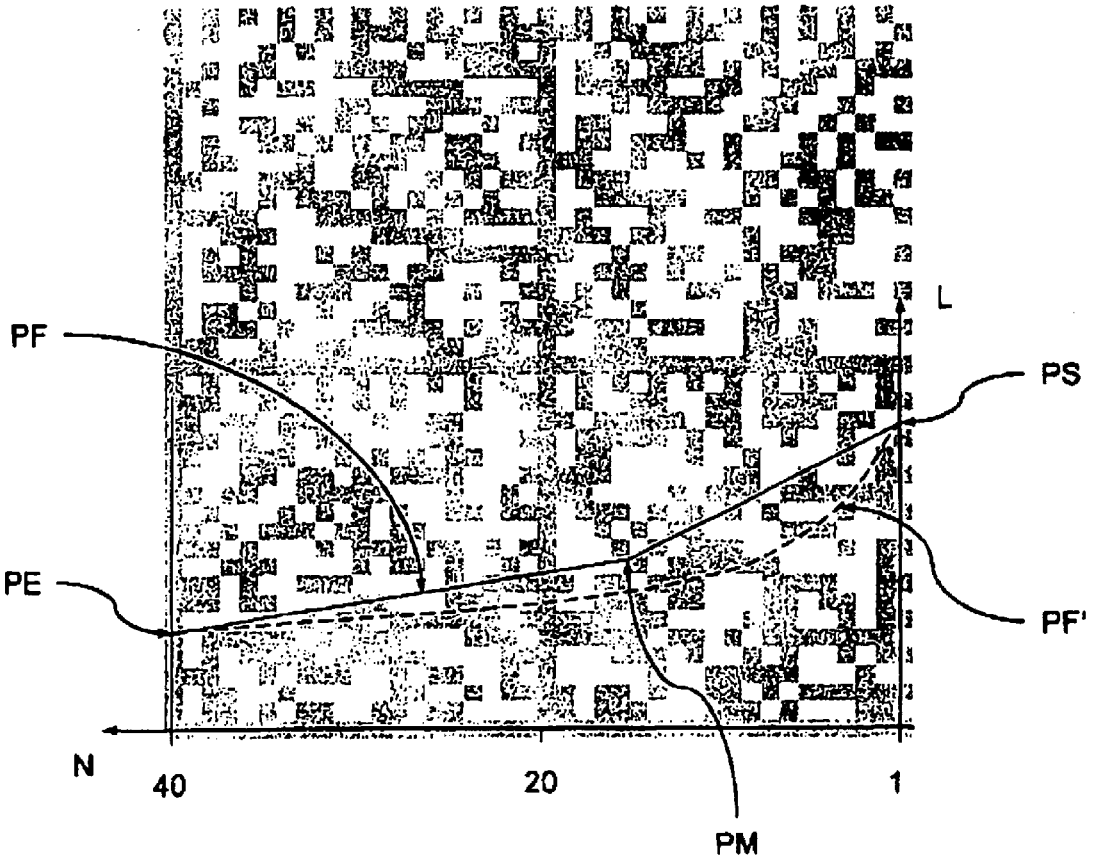
FIG. 6 illustrates a phase length function that can be used in the method of FIG. 2.

Furthermore, in the present example the processing unit 101.4 possibly calculates a phase length function PF in the step 106.3, as is schematically shown in FIG. 6. The phase length function thereby designates the dependency of the phase length L of the energy pulses fed to the respective printing element 102.3 for generation of an image point on the number N of the module column to be printed. In other words, the phase length function PF defines the phase length L dependent on the position of the image point in the barcode 104.2 and therewith ultimately also the energy quantity which is fed to the printing element 102.3 for generation of this image point.

In the present example the phase length function PF is also calculated, using a series of input parameters, from a parameterized master function MPF that is stored in the second memory 101.5.

In principle any suitable parameters which have an influence on the energy quantity to be fed to a printing element 102.3 for generation of an image point can be used as input parameters for the calculation of the phase length function PF. In the present example the phase length function PF is calculated using at least one part of the printing parameters (read out from the first memory 103.4) of the ink ribbon 103.1 as an input parameter as well as the temperature measurement value T representative for the current temperature of the print head 102.1 as a further input parameter.

In other variants of the invention a phase length function set in which are stored different phase length functions for different combinations of the input parameters can also be provided instead of the calculation of the phase length function via a master function. The respective current phase length function to be used then does not have to be calculated, but rather is simply selected from the appertaining phase length function set using the current combination of the input parameters.

In other variants of the invention, for variation of the energy quantity that is to be fed to the respective printing element, a different parameter influencing the energy quantity than the phase length L can be used, dependent on the position of the image point to be generated in the barcode (in particular dependent on the number of the module column in which the image point is located). For example, it is possible for this purpose to vary the current strength and/or the voltage of the energy pulses dependent on the position of the image point in the barcode along the printing direction D.

The phase length function PF can be defined in any suitable manner. It can thus be defined via an arbitrary suitable number of support points, whereby values lying between these support points can then possibly be interpolated. An arbitrary desired curve (in particular an arbitrary curved course of the phase length function) can in particular be provided as it is indicated by the dashed contour PF in FIG. 6.

As is to be learned from FIG. 6, the master function MPF (and therewith the phase length function PF) in the present example is defined by three support points, namely the start support point MPS or PS, a middle (in-between) support point MPM or PM and an end support point MPE or PE. The parameterization of the master function MPF can thereby be selected such that, dependent on the input parameters cited above, the phase length values L of the respective support point PS, PM and PE on the one hand and the column value N of the middle support point PM on the other hand can be varied. However, it is also possible that only a part of these values is varied.

The calculation of the current phase length function PF can ensue in each r-th pass of the step 106.3 (with r=1). The calculation can also be linked to the occurrence of arbitrary other temporal and non-temporal conditions or events. This calculation can be implemented in the step 106.3 only when one of the aforementioned input parameters of the calculation has changed by more than a predetermined value. Depending on its severity, such a change can even force a restart of the method workflow in the step 106.1. The same naturally also applies for the selection of the phase length function in the cited variants without calculation of the phase length function via the master function.

In other variants of the invention both the master energy templates and the master function MPF can be stored in the memory 103.4 of the ink ribbon cassette 103. In the described variants without master energy templates or master function the energy templates or, respectively, the phase length functions can likewise be stored in the memory 103.4 of the ink ribbon cassette 103.

In the step 106.4 the processing unit 101.4 selects the next image point to be considered for which the energy quantity is to be set for the printing of the barcode 104.2. In the first pass of the step 106.4 this is naturally the first image point for which the energy quantity is to be set for printing of the barcode 104.2.

Dependent on the barcode module type of the current barcode module with which this current image point is associated (consequently thus dependent on the position of the current image point to be considered in the barcode 104.2), the processing unit 101.4 then initially selects the current energy template set in a step 106.5. The current energy template is subsequently selected from this current energy template set dependent on the print status constellation of the neighboring modules of the current barcode module (which results from the print image calculated in step 106.3). From the current energy template (for example the energy template 107.1 from FIG. 5A) the processing unit 101.4 then reads the number Z of the energy pulses that are to be fed to the appertaining printing element 102.3 to generate the current image point, and said processing unit 101.4 stores this number Z in a suitable control data set.

Dependent on the number N of the module column of the current barcode module with which this current image point is associated (consequently thus dependent on the position of the current image point to be considered in the barcode 104.2), in a step 106.6 the processing unit 101.4 then determines from the phase length function PF the current phase length L of the energy pulses that are to be fed to the appertaining printing element 102.3 to generate the current image point and stores this phase length L in a suitable control data set. The control values determined for the current image point, thus the number Z and the phase length L, are stored suitably associated or suitably linked with one another.

In a step 106.7 the processing unit 101.4 checks whether the control values for the control data set are yet to be determined for a further image point of the barcode 104.2. If this is the case, the workflow jumps back to the step 106.4

It is understood that in advantageous variants of the inventive method with a particularly fast processing of the data it can also be provided that, in a combination of the steps 106.5 and 106.6, the processing unit 101.4 immediately determines the values Z as well as the phase length L for a number of image points that are associated with the current barcode module. For example, the values Z for all image points arranged in the same print column can thus be determined immediately and these are then associated with the identical phase length L.

If applicable even all values Z of the image points associated with the current barcode module can likewise be determined and corresponding (in the present example likewise identical) values for the phase length L can then be associated therewith. In this case the processing unit 101.4 then must effect a corresponding sorting of the control values in the control data set (possibly already upon storage of the control values or subsequently) insofar as a sequential arrangement of the control values is required for the control of the printing elements 102.3.

If in a step 106.7 the processing unit establishes that the control values for the control data set are to be determined for no further image point of the barcode 104.2, the determination step 106.8 (comprising the steps 106.4 through 106.7) of the method is concluded. After conclusion of all further preparations for generation of the franking imprint 104.1, in a feed step 106.9 the processing unit 101.4 then controls the printing elements 102.3 of the print head 102.1 to generate the franking imprint 104.1 using the control data set described above.

The printing of the franking imprint 104.1 ensues in columns. To generate a print column in a control sequence using the control data set, all printing elements 102.3 of the print head 102.1 to be controlled according to the print image 104.1 to be generated are thereby controlled by the processing unit 101.4. To generate the next print column, all printing elements of the print head 102.1 to be controlled according to the print image 104.1 to be generated are then in turn controlled in a further control sequence using the control data set.

If no further printing element is to be controlled, for example because all columns of the print image 104.1 have been printed or a termination occurred, in a step 106.10 it is finally checked whether the method workflow should be ended. If this is the case, the method workflow ends in a step 106.11. Otherwise the workflow jumps back to the step 106.2.

The present invention was described in the preceding using an example in which the control data (consequently thus the energy quantities for the printing elements 102.3) for the entire print image have been determined in advance. However, it is understood that in other variants of the method it can also be provided that the determination of the control data (number Z and phase length L of the pulses) can be separately determine immediately before the activation for every single activation of a printing element. In other variants of the invention, a procedure between these extreme variants can be provided. For example, the determination can thus ensue in advance for the respective print column. The determination of the energy quantities can thereby already ensue while the control sequence for the preceding print column runs, such that no noticeable time loss is connected with this determination.

The present invention was described using examples in which the control dependent on the position of the appertaining image point in the barcode ensues through a combination of the use of energy templates with the use of phase length functions. In other variants of the invention control of the printing elements dependent on the position of the appertaining image point in the barcode can be effected exclusively by energy templates or exclusively by one or more phase length functions. Particularly given the use of energy templates, the energy templates can be additionally varied in the printing direction D.

Furthermore, the present invention was described using examples with a two-dimensional barcode, but it is understood that the invention can also be used for one-dimensional barcodes. The use of the phase length function is particularly suitable for the position-dependent adjustment of the energy quantity given such one-dimensional barcodes.

Moreover, the present invention was described using examples with a franking machine, but it is understood that the invention can also be used for arbitrary other applications in which a print image is generated.

Although modifications and changes may be suggested by those skilled in the art, it is the intention of the inventors to embody within the patent warranted hereon all changes and modifications as reasonably and properly come within the scope of their contribution to the art.

We claim as our invention:

1. A method for controlling a thermotransfer print head comprising a plurality of individually activatable printing elements, for use with an ink carrier device for printing on a printing medium, said method comprising the steps of:

in a feed step, supplying respective energy quantities from an energy source to selected printing elements, among said plurality of printing elements, that are selected in a processor, to cause transfer of ink from the ink carrier device onto the printing medium to generate a plurality of image points collectively forming a barcode, with each image point having a position in the barcode, said barcode being a two-dimensional barcode comprised of a plurality of printed and non-printed barcode modules in a matrix, each barcode module comprising a plurality of said image points, with each barcode module having a module position in said two-dimensional barcode;

in a determination step implemented in said processor separate from said feed step, determining the respective energy quantity to be supplied to the printing element in said feed step dependent on the respective position of said image point in said barcode and determining the respective energy quantities to be supplied to the printing elements in said feed step dependent on the position of the barcode module in the two-dimensional barcode in which the image point to be printed by the respective printing element is contained;

for each of said barcode modules, defining, in said processor, a print status thereof dependent on whether that barcode module is a printed or a non-printed barcode module;

for each of said barcode modules, identifying, in said processor, predetermined neighboring barcode modules that are among barcode modules in the two-dimensional barcode that are adjacent to that barcode module;

in said determination step, determining the energy quantity to be supplied to the respective printing elements in said feed step dependent on the print status of the predetermined neighboring barcode modules of the barcode module in which the respective printing element will generate an image point;

for each print status configuration of said predetermined neighboring barcode modules, identifying, in said processor, a separate energy template therefor; and in said determination step, determining the energy quantity to be fed to the respective printing elements in the feed step using the energy template for the existing print status configuration of said predetermined neighboring barcode modules.

2. A method as claimed in claim 1 comprising:

in said feed step, delivering the respective energy quantity to the respective printing element as a plurality of current pulses supplied to each printing element; and formulating each energy template as a plurality of values respectively representing a number of current pulses to be supplied to the respective printing elements for printing the respective image points.

3. A method as claimed in claim 1 comprising defining each energy template as a fixed pattern for the print status configuration associated therewith.

4. A method as claimed in claim 1 wherein said thermotransfer print head, at respectively different times, exhibits different physical states and comprising:

for each of said different physical states of said thermotransfer print head, defining a fixed energy template for each of said print status configurations; and selecting said energy template dependent on the current physical state of the thermotransfer print head and the current print status configuration of said predetermined neighboring barcode modules.

5. A method as claimed in claim 4 comprising using a temperature of said print head as a value representative of said physical state of said thermotransfer print head.

6. A method as claimed in claim 1 comprising determining a current physical state of the thermotransfer print head and calculating the energy template for the current print status configuration dependent on said current physical state.

7. A method as claimed in claim 6 comprising using a current temperature of the thermotransfer print head as a value of representative of said current physical state.

8. A method as claimed in claim 6 comprising calculating said energy template starting from a parameterized master energy template.

9. A method as claimed in claim 6 comprising calculating said energy template upon an occurrence selected from the group consisting of predetermined conditions and predetermined events.

10. A method as claimed in claim 1 wherein each energy quantity supplied to each of said printing elements comprises a variable energy feed parameter, and adjusting the respective energy quantity supplied to the respective printing element in said feed step by varying said energy feed parameter dependent on the position of the image point in the barcode to be printed by the respective printing element.

11. A method as claimed in claim 10 comprising supplying said energy quantity to each of said printing elements in a plurality of current pulses, and for each of said current pulses, selecting said variable parameter from the group consisting of pulse voltage, pulse current strength, and pulse duration.

12. A method as claimed in claim 10 comprising supplying said energy quantity to the respective printing elements in a plurality of current pulses for each printing element, using pulse duration as said variable energy feed parameter, and adjusting said energy quantity using a phase length function representing a relationship between the pulse duration and the position of the image point in the bar code to be printed by a respective printing element.

13. A method as claimed in claim 12 comprising using a fixed function as said phase length function.

14. A method as claimed in claim 12 comprising determining a fixed phase length function for each of a plurality of different physical states of the print head, and using the phase length function corresponding to the current state of the print head for adjusting said energy quantity in said feed step.

15. A method as claimed in claim 14 comprising using a temperature of said print head as a value representative of said physical state.

16. A method as claimed in claim 12 comprising calculating said phase length function dependent on a current physical state of the print head.

17. A method as claimed in claim 16 comprising calculating said phase length function dependent on a temperature of said print head as a value representative of said physical state.

18. A method as claimed in claim 16 comprising calculating said phase length function starting from a parameterized master phase length function.

19. A method as claimed in claim 16 comprising calculating said phase length function dependent on an occurrence selected from the group consisting of predetermined conditions and predetermined events.

20. A method as claimed in claim 1 comprising employing a two-dimensional barcode as said barcode.

* * * * *